US010094372B2

(12) United States Patent
Stein et al.

(10) Patent No.: US 10,094,372 B2
(45) **Date of Patent: *Oct. 9, 2018**

(54) FLUID-WORKING MACHINE AND OPERATING METHOD

(71) Applicant: Artemis Intelligent Power Limited, Loanhead, Midlothian (GB)

(72) Inventors: Uwe Bernhard Pascal Stein, Midlothian (GB); Niall James Caldwell, Midlothian (GB); William Hugh Salvin Rampen, Midlothian (GB); Jonathan Paul Almond, Midlothian (GB)

(73) Assignee: ARTEMIS INTELLIGENT POWER LIMITED, Loanhead, Midlothian (GB)

( * ) Notice: Subject to any disclaimer, the term of this patent is extended or adjusted under 35 U.S.C. 154(b) by 374 days.

This patent is subject to a terminal disclaimer.

(21) Appl. No.: 14/942,567

(22) Filed: Nov. 16, 2015

(65) Prior Publication Data

US 2016/0169222 A1 Jun. 16, 2016
US 2017/0298928 A9 Oct. 19, 2017

Related U.S. Application Data

(63) Continuation of application No. 12/929,497, filed on Jan. 28, 2011, now Pat. No. 9,188,119, which is a (Continued)

(30) Foreign Application Priority Data

Sep. 12, 2002 (GB) ..... 0221165.4

(51) Int. Cl.
*F04B 49/06* (2006.01)
*F04B 49/22* (2006.01)
(Continued)

(52) U.S. Cl.
CPC ..... *F04B 49/225* (2013.01); *F01B 25/10* (2013.01); *F04B 7/0076* (2013.01); (Continued)

(58) Field of Classification Search
CPC ..... F04B 49/24; F04B 49/243; F04B 49/065; F04B 2201/0807
See application file for complete search history.

(56) References Cited

U.S. PATENT DOCUMENTS 3,643,433 A 2/1972 Widmaier
4,945,816 A 8/1990 Mestieri
(Continued)

FOREIGN PATENT DOCUMENTS

JP 62-029779 2/1987
JP 5-503335 6/1993

*Primary Examiner* — Patrick Hamo
(74) *Attorney, Agent, or Firm* — Hauptman Ham, LLP

(57) ABSTRACT

A fluid-working machine has a plurality of working chambers, e.g., cylinders, of cyclically changing volume, a high-pressure fluid manifold and a low-pressure fluid manifold, at least one valve linking each working chamber to each manifold, and electronic sequencing means for operating said valves in timed relationship with the changing volume of each chamber, wherein the electronic sequencing means is arranged to operate the valves of each chamber in one of an idling mode, a partial mode in which only part of the usable volume of the chamber is used, and a full mode in which all of the usable volume of the chamber is used, and the electronic sequencing means is arranged to select the mode of each chamber on successive cycles so as to infinitely vary the time averaged effective flow rate of fluid through the machine.

21 Claims, 3 Drawing Sheets

Related U.S. Application Data continuation of application No. 10/526,444, filed as application No. PCT/GB03/03949 on Sep. 11, 2003.

(51) Int. Cl.

| | |
|---|---|
| ***F04B 49/24*** | (2006.01) |
| ***F04B 53/10*** | (2006.01) |
| ***F04B 7/00*** | (2006.01) |
| ***F04B 49/12*** | (2006.01) |
| ***F01B 25/10*** | (2006.01) |

(52) U.S. Cl.

CPC ..... *F04B 49/065* (2013.01); *F04B 49/12* (2013.01); *F04B 49/243* (2013.01); *F04B 53/1082* (2013.01); *F04B 2201/02* (2013.01); *F04B 2201/0807* (2013.01)

(56) References Cited

U.S. PATENT DOCUMENTS

| | | | | |
|---|---|---|---|---|
| 5,259,738 | A | 11/1993 | Salter et al. | |
| 5,259,783 | A | 11/1993 | Hileman et al. | |
| 5,456,581 | A * | 10/1995 | Jokela ..... | F04B 1/18 417/270 |
| 6,183,207 | B1 | 2/2001 | Sturman | |
| 6,651,545 | B2 | 11/2003 | Nippert | |
| 6,652,240 | B2 | 11/2003 | Wichert | |
| 9,188,119 | B2 * | 11/2015 | Stein ..... | F04B 7/0076 |
| 2005/0179185 | A1 | 8/2005 | Song et al. | |

* cited by examiner

FLUID-WORKING MACHINE AND OPERATING METHOD

CROSS REFERENCE TO RELATED APPLICATION

This is a continuation of U.S. application Ser. No. 10/526,444, filed Mar. 1, 2005, which in turn is a national phase application of PCT/GB2003/003949 filed Sep. 11, 2003 which is based on priority application GB 0221165.4, filed Sep. 12, 2002, the entire contents of each of which are hereby incorporated by reference in this application.

BACKGROUND TO THE INVENTION

This invention relates to a fluid-driven (motor) and/or fluid-driving (pump) machine having a plurality of working chambers of cyclically changing volume and valve means to control the connection of each chamber to low and high-pressure manifolds. The invention also relates to a method of operating the machine.

The invention has particular reference to non-compressible fluids, but its use with gases is not ruled out. It has particular reference to machines where the at least one working chamber comprises a cylinder in which a piston is arranged to reciprocate, but its use with at least one chamber delimited by a flexible diaphragm or a rotary piston is not ruled out.

With most fluid working machines the fluid chambers undergo cyclical variations in volume following a sinusoidal function. It is known to provide flow rectifying seating valves, allowing fluid to be admitted and exhausted from the working chamber, which valves are electro-magnetically actuated such that pumping and motoring strokes can be achieved. The chamber can be left to idle by holding the valve, between the working chamber and the low-pressure sump, in the open condition.

A shaft position sensor is used to provide the micro-controller with chamber phase information while flow or pressure demand inputs influence the rate at which chambers are pumped, motored or left idle. The micro-controller drives semiconductor switches, such as field effect transistors, which in turn actuate the valves connecting the chambers to either the high-pressure manifold or low-pressure sump.

Experience shows that varying the timing of the valves, such that portions of the stroke are disabled, in order to vary machine output creates a significant amount of audible and fluid borne noise.

The development of electro-magnetically actuated; seating valves working in conjunction with a varying fluid chamber volume, such as described in EP-A-361927 and EP-A-0494236, permitted the output of a fluid working machine having a plurality of working chambers to be varied, in a time averaged way, by the rate of selection of whole chambers as they became available at the ends of each expansion or contraction cycle.

EP-A-0361927 described the use of this technique for a pump in which shaft power was controllably converted to fluid power. EP-A-0494236 continued the concept and, by introducing a new mechanism for actuating the valves in a motoring cycle, developed the machine to allow a controllable bi-directional energy flow.

A multi-piston hydraulic machine according to EP-A-0494236 is shown in schematic section in FIG. 1. In the side wall of each cylinder 11 is a poppet valve 13 communicating with a high-pressure manifold 14 and in the end wall of each cylinder is a poppet valve 15 communicating with a low-pressure manifold 16. The poppet valves 13 and 15 are active electromagnetic valves controlled electrically by a microprocessor controller 20 feeding control signals, via optoisolators 21, to valve-driving semiconductors 22.

Pistons 12 act on a drive cam 23 fast to an output shaft 24, the position of the cam 23 being sensed by an encoder 25.

The controller 20 receives inputs from the encoder 25, a pressure transducer 26 (via an analogue to digital converter 27) and via a line 28 to which a desired output speed demand signal can be applied.

The poppet valves 13, 15 seal the respective cylinders 11 from the respective manifolds 14, 16 by engagement of an annular valve part with an annular valve seat, a 30 solenoid being provided to magnetically move each said valve part relative to its seat by reacting with ferromagnetic material on the said poppet valve, each said poppet valve having a stem and an enlarged head, the annular valve part being provided on the head and the ferromagnetic material being provided on the stem.

In EP-A-361927 and EP-A-0494236, whole chambers were selected on the basis that valve actuation could be done during the instances of near zero flow. It was considered that delayed closure of valves, occurring during times of significant flow, such that part of the chamber displacement could be rejected, would result in extremely high rates of change of flow and pressure, which in turn would generate noise.

The approach of whole chamber selection works well for high flow rates, seeing as the mechanical payload, driven by this type of system, typically has a large momentum such that variations in flow energy cause relatively small changes in its velocity and, therefore, acceleration.

However, in practice it was found that whole chamber selection during times of low flow demand resulted in large flow variations, seeing as the fluid machine was idle for long instances between active chambers. When a payload has a small velocity, as it will when the actuating flow is low, the momentum will also be minimal. If each actuated chamber is considered to be delivering a quantum of energy to the payload, then the change in velocity will be significantly higher when the initial energy is low.

SUMMARY OF THE INVENTION

The invention seeks to address this problem such that a smooth actuating response can be achieved at the payload.

The present invention provides a fluid-working machine having a plurality of working chambers of cyclically changing volume, a high-pressure fluid manifold and a low-pressure fluid manifold, at least one valve linking each working chamber to each manifold, and electronic sequencing means for operating said valves in timed relationship with the changing volume of each chamber, wherein the electronic sequencing means is arranged to operate the valves of each chamber in one of an idling mode, a partial mode in which only part of the usable volume of the chamber is used, and a full mode in which all of the usable volume of the chamber is used, and the electronic sequencing means is arranged to select the mode of each chamber on successive cycles so as to vary the time averaged effective flow rate of fluid through the machine.

In a most preferred embodiment of the invention, the partial mode comprises the use of only a small fraction of the usable volume of the chamber.

Preferably, the machine is operable as both a pump and a motor, each chamber having five selectable modes, namely idling mode, partial motoring mode, full motoring mode, partial pumping mode and full pumping mode.

Preferably, the working chambers comprise cylinders in which pistons are arranged to reciprocate. If so, the partial pumping mode preferably includes closing the valve linking the cylinder to the low-pressure manifold and opening the valve linking the cylinder to the high-pressure manifold a small fraction in advance of the top dead centre position of the piston. The partial motoring mode preferably includes closing the valve linking the cylinder to the high-pressure manifold and opening the valve linking the cylinder to the low-pressure manifold a small fraction after the top dead centre position of the piston.

If valve actuations are delayed in this way to almost the end of the stroke, then the rate of change of chamber volume will be at an acceptably low level to permit valve actuation. This means that a small fraction of a whole cylinder can also be selected by the controller to add to the machine's output. The range over which this is practicable is limited by stability of valve operation, on the low flow end, and by machine noise on the higher end. In practice this range is sufficiently limited that it is considered to have added two distinct, low-flow, modes to the three-mode machine, providing the above-mentioned range of five modes to the controller at any time that a chamber comes to the position at which an action can be taken.

The invention also provides a method of operating a fluid-working machine having a plurality of working chambers of cyclically changing volume, a high-pressure fluid manifold and a low-press fluid manifold, at least one valve linking each working chamber to each manifold, comprising operating the valves of each chamber in one of an idling mode, a partial mode in which only part of the usable volume of the chamber is used, and a full mode in which all of the usable volume of the chamber is used, wherein the mode of each chamber is selected on successive cycles so as to vary the time averaged effective flow rate of fluid through the machine.

Preferably, the method comprises selecting the number of chambers to be operated in each of said modes according to an algorithm depending on the actual and required output of the machine.

In a most preferred embodiment of the invention, the partial mode comprises the use of only a small fraction of the usable volume of the chamber.

The method may comprise a preliminary step of selecting whether to operate the machine as a pump or a motor, and choosing the algorithm accordingly.

BRIEF DESCRIPTION OF THE DRAWINGS

In order that the invention may be more readily understood, embodiments thereof will now be described, by way of example only, with reference to the accompanying drawings, in which.

DETAILED DESCRIPTION OF PARTICULAR EMBODIMENTS

Figure 1:
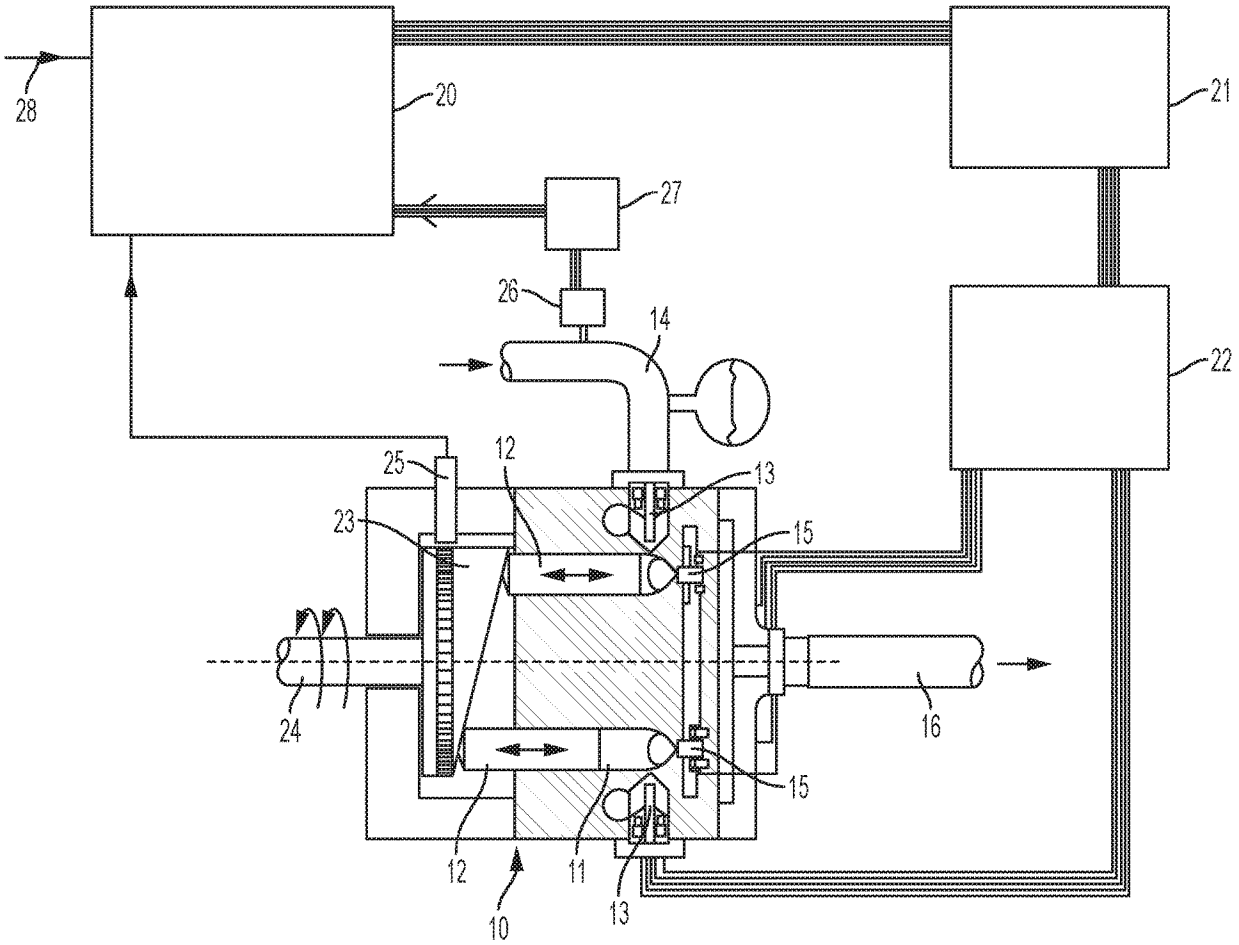
FIG. 1 PRIOR ART
FIG. 1 is a schematic sectional view of the known fluid-working machine described above which can be adapted according to the present invention.

The machine described in EP-A-0494236 and shown in FIG. 1 can be adapted to provide a machine according to the invention without additional hardware to create a part-stroke mode. The adaptation consists of increasing the functionality and complexity of the microprocessor control algorithms.

At any one instant there are four possible states for any of the chambers 11: (1) intake from the low-pressure manifold, (2) exhaust to the low-pressure manifold, (3) intake from the high-pressure manifold and (4) exhaust to the high-pressure manifold.

Let "mode" denote a repeating cyclic sequence of transitions from one of these states to another. There are five distinct modes: full stroke pumping, part stroke pumping, full stroke motoring, part stroke motoring, and idling.

Figure 2:
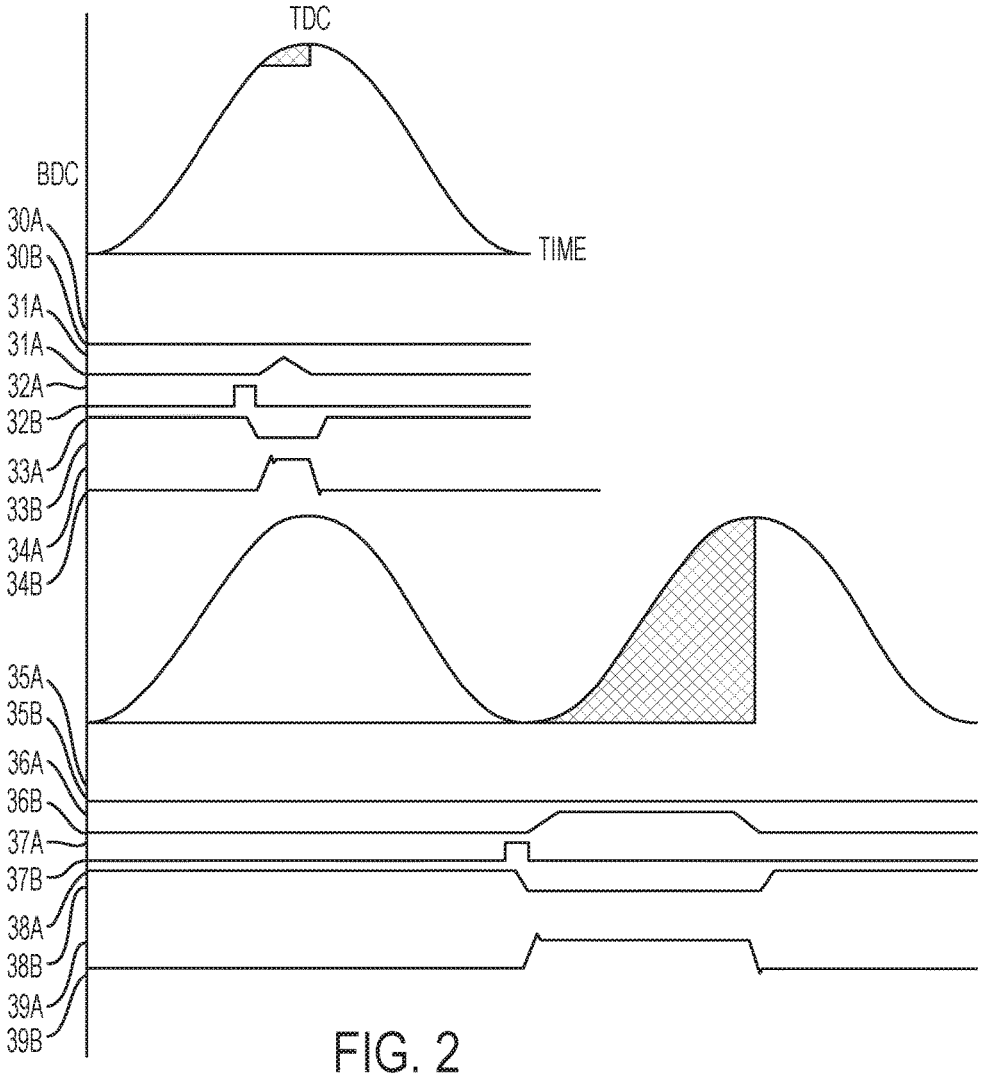
FIG. 2 is a pulse and timing diagram for the adapted machine when operating as a pump.
Figure 3:
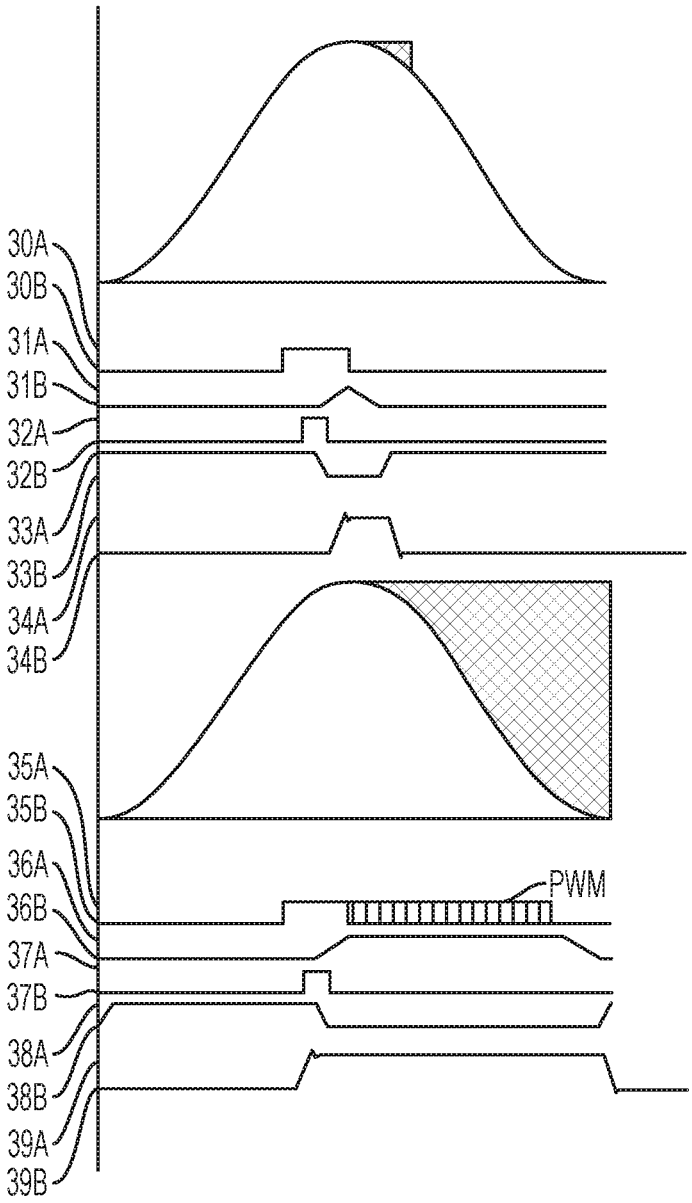
FIG. 3 is a pulse and timing diagram for the adapted machine when operating as a motor.

The difference between full and part stroking modes is the phase angle at which transitions are made from one of these states to the other relative to bottom and top dead centre of piston movement:

FIGS. 2 and 3 are timing diagrams for pumping and motoring respectively, showing piston position, the states of electronic gates for controlling the high-pressure and low-pressure valves, the positions of those valves and the cylinder pressure, all plotted against time. The shaded portions indicate active portions of the piston stroke. For example, the top half in FIGS. 2 and 3 shows HPV Gate On 30A, HPV Gate Off 30B, HPV at Open Position 31A, HPV at Shut Position 31B, LPV Gate On 32A, LPV Gate Off 32B, LPV at Open Position 33A, LPV at Shut Position 33B, High Cylinder Pressure 34A, and Low Cylinder Pressure 34B. The bottom half in FIGS. 2 and 3 shows HPV Gate On 35A, HPV Gate Off 35B, HPV at Open Position 36A, HPV at Shut Position 36B, LPV Gate On 37A, LPV Gate Off 37B, LPV at Open Position 38A, LPV at Shut Position 38B, High Cylinder Pressure 39A, and Low Cylinder Pressure 39B.

In the case of full stroke pumping mode, shown at the bottom right of FIG. 2, the transition from state (1) to state (4) happens at or near to bottom dead centre causing the full cylinder volume to be pumped into the high-pressure manifold.

In the case of part stroke pumping mode, shown in the top half of FIG. 2, the transition from state (1) to state (4) happens a small fraction in advance of top dead centre, causing only a small fraction of the cylinder volume to be pumped into the high-pressure manifold.

In both pumping modes the transition from state (4) to state (1) happens at or near to top dead centre.

In the case of full stroke motoring mode, shown in the bottom half of FIG. 3, the transition from state (3) to state (2) happens at or near to bottom dead centre, causing the full cylinder volume to be inducted from the high-pressure manifold. The transition from state (2) to state (3) happens at or near to top dead centre.

In the case of part stroke motoring mode, shown in the top half of FIG. 3, the transition from state (3) to state (1) happens a small fraction after top dead centre, causing only a small fraction of the cylinder volume to be inducted from the high-pressure manifold. The transition from state (1) to state (2) happens at bottom dead centre. The transition from state (2) to state (3) happens at or near to top dead centre of piston movement.

In the case of idling mode, shown at the bottom left of FIG. 2, the transition from state (1) to state (2) happens at bottom dead centre of piston movement. The transition from state (2) to state (1) happens at top dead centre of piston movement.

A sequence of mode changes on successive machine cycles mixing pumping or motoring modes with idling modes allows the time averaged effective flow rate into and out of the high-pressure manifold to be infinitely varied between full pumping flow, zero flow, and full motoring flow.

Since the machine has a plurality of chambers, and each chamber may be set in any of five states, then many instantaneous configurations are possible. Some physical limitations exist however, in that a chamber which has been selected for full-stroke operation cannot, on the same part of the cycle, be selected for part-stroke use.

Control Over the Full Range of Output

The flow control method described in EP-A-0361927 and EP-A-0494236, which used a displacement demand during an accounting interval, combined with a look-ahead algorithm, can be extended for use with the five-mode machine of the invention. At zero flow the machine is in a permanent idling mode. At low flows the operation sequence is composed of partial stroke and idling modes with the fraction of these two modes reflecting the demand level. As flow demand increases, the fraction of partial stroke modes relative to idling modes increases. At some stage the controller begins to use occasional full stroke modes interspersed with idle and part-stroke modes to continue the ramping up of flow. Starting from the other end of the range at full flow output, the machine is in permanent full stroke mode. As flow demand drops, idling modes are interspersed with full stroke modes, leaving regular gaps in the flow rate. This process continues until the ratio of full stroke modes to idling modes falls below a fixed or variable threshold, at which point the controller begins mixing idle modes, part stroke modes and full stroke modes. The mixture of modes of operation, where three modes are being employed in a sequence, is tailored for the smoothest flow result and/or the most seamless change in audible noise and/or minimal pressure ripple and/or optimum actuator motion. Several algorithms are possible to mix states over this range.

In the case of pressure control, the decision on the mixture of modes in the sequence is based upon some function of the error between the measured and demanded pressure, and optionally the time history of past system responses to past pumping/motoring decisions allowing for adaptive techniques to minimise pressure fluctuation in response to varying system parameters.

In the case of position or velocity control of an hydraulic actuator, the decision on the mixture of modes in the sequence is based upon some function of the error between the measured and demanded position or velocity, and optionally the time history of past system responses to past pumping/motoring decisions allowing for adaptive techniques to minimise position or velocity error in response to varying system parameters.

As alternatives to electromagnetic valves, valves operating by piezoelectric or magnetostrictive means could be used in the invention.

All forms of the verb "to comprise" used in this specification have the meaning "to consist of or include".

What is claimed is:

1. A method of operating a fluid-working machine having a plurality of working chambers of cyclically changing volume, said working chambers comprising cylinders within which pistons are arranged to reciprocate, a high-pressure fluid manifold and a low-pressure fluid manifold, at least one valve linking each working chamber of said working chambers to each manifold, the method comprising:

operating the valves of at least one of said working chambers in a partial motoring mode in which only part of the usable volume of the at least one working chamber is used; and determining a mode of each working chamber of said working chambers on successive cycles of changing working chamber volume so as to vary the time averaged effective flow rate of fluid through the machine according to a demand level; and operating the valves of each of said working chambers to select the determined mode in accordance with an operation sequence which, in the successive cycles of changing working chamber volume, intersperses modes including at least (i) idling modes, and (ii) said partial motoring modes, wherein the sequence of modes of operation is based upon a function of the error between the measured and demanded pressure.

2. A method of operating a fluid-working machine having a plurality of working chambers of cyclically changing volume, said working chambers comprising cylinders within which pistons are arranged to reciprocate, a high-pressure fluid manifold and a low-pressure fluid manifold, at least one valve linking each working chamber of said working chambers to each manifold, the method comprising:

operating the valves of at least one of said working chambers in a partial motoring mode in which only part of the usable volume of the at least one working chamber is used; and determining a mode of each working chamber of said working chambers on successive cycles of changing working chamber volume so as to vary the time averaged effective flow rate of fluid through the machine according to a demand level; and operating the valves of each of said working chambers to select the determined mode in accordance with an operation sequence which, in the successive cycles of changing working chamber volume, intersperses modes including at least (i) idling modes, and (ii) said partial motoring modes, wherein the sequence of modes of operation is based upon the time history of past systems responses to past decisions.

3. A fluid-working machine comprising:

a plurality of working chambers of cyclically varying volume, said working chambers comprising cylinders within which pistons are arranged to reciprocate;

a high-pressure fluid manifold;

a low-pressure fluid manifold;

at least one valve linking each working chamber of said working chambers to each manifold; and a controller having a configuration to operate the valves of at least one of the said working chambers in a partial motoring mode in which only part of the usable volume of the at least one working chamber is used, wherein the controller is further configured to: vary the time averaged effective flow rate of fluid through the machine according to a demand level, and operate the valves of each of the working chambers to select the determined mode in accordance with an operation sequence which, in the successive cycles of changing working chamber volume, intersperses modes including at least (i) idling modes, (ii) said partial motoring modes, wherein the sequence of modes of operation is based upon a function of the error between the measured and demanded pressure.

4. A fluid-working machine comprising:

a plurality of working chambers of cyclically varying volume, said working chambers comprising cylinders within which pistons are arranged to reciprocate;

a high-pressure fluid manifold;

a low-pressure fluid manifold;

at least one valve linking each working chamber of said working chambers to each manifold; and a controller having a configuration to operate the valves of at least one of the said working chambers in a partial motoring mode in which only part of the usable volume of the at least one working chamber is used, wherein the controller is further configured to: vary the time averaged effective flow rate of fluid through the machine according to a demand level, and operate the valves of each of the working chambers to select the determined mode in accordance with an operation sequence which, in the successive cycles of changing working chamber volume, intersperses modes including at least (i) idling modes, (ii) said partial motoring modes, wherein the sequence of modes of operation is based upon the time history of past systems responses to past decisions.

5. A machine comprising: a plurality of working chambers of cyclically changing volume; a high-pressure fluid manifold; a low-pressure fluid manifold; at least one valve linking each working chamber to each manifold; and a controller having a configuration to: determine a mode of each working chamber on successive cycles of changing working chamber volume so as to vary the time averaged effective flow rate of fluid through the machine according to a demand level, and operate the valves of each of the working chambers to select the determined mode in accordance with an operation sequence which, in the successive cycles of changing working chamber volume, intersperses modes including at least (i) idling modes, (ii) partial stroke modes in which only part of the usable volume of the working chamber is used and (iii) full stroke modes in which all of the usable volume of the working chamber is used.

6. The machine of claim 5, wherein the demand level is varied in use.

7. The machine of claim 5, wherein the partial stroke modes comprise use of only a small fraction of the usable volume of the working chambers, and wherein the small fraction is one in which valve actuations are delayed to almost the end of the stroke such that a rate of change of working chamber volume will be at an acceptably low level to permit valve actuation.

8. The machine of claim 5, wherein the partial stroke modes comprise use of only a small fraction of the usable volume of the working chambers, and wherein the small fraction is one that provides sufficient stability of valve operation at the low flow end.

9. The machine of claim 5, wherein, in the partial modes, valve actuations are delayed to almost an end of a stroke such that a rate of change of working chamber volume will be at an acceptably low level to permit valve actuation.

10. The machine of claim 5, wherein the partial stroke modes are part stroke motoring modes in which the transition from intake from the high-pressure manifold to intake from the low pressure manifold happens a small fraction after top dead center, wherein the small fraction is one in which valve actuations are such that a rate of change of working chamber volume will be at an acceptably low level to permit valve actuation.

11. The machine of claim 5, wherein the sequence of modes of operation is tailored for one or more of the smoothest flow result, the most seamless change in audible noise, minimal pressure ripple, and optimum actuator motion.

12. A machine comprising: a plurality of working chambers of cyclically changing volume; a high-pressure fluid manifold; a low-pressure fluid manifold; at least one valve linking each working chamber to each manifold; and a controller having a configuration to: vary the time averaged effective flow rate of fluid through the machine according to a demand level, and operate the valves of each of the working chambers to select the determined mode in accordance with an operation sequence which, in the successive cycles of changing working chamber volume, intersperses modes including at least (i) idling modes, (ii) partial stroke modes in which only part of the usable volume of the working chamber is used and (iii) full stroke modes in which all of the usable volume of the working chamber is used.

13. A method of operating a fluid-working machine having a plurality of working chambers of cyclically changing volume, a high-pressure fluid manifold and a low-pressure fluid manifold, at least one valve linking each working chamber to each manifold, the method comprising:

determining a mode of each of the working chambers on successive cycles of changing working chamber volume so as to vary the time averaged effective flow rate of fluid through the fluid-working machine according to a demand level; and operating the valves of each of the working chambers to select the determined mode in one of (i) an idling mode, (ii) a partial stroke mode in which only part of the usable volume of the working chamber is used, and (iii) a full stroke mode in which all of the usable volume of the working chamber is used, wherein the sequence of modes of operation is tailored for one or more of the smoothest flow result, the most seamless change in audible noise, minimal pressure ripple, and optimum actuator motion.

14. A method of operating a fluid-working machine having a plurality of working chambers of cyclically changing volume, a high-pressure fluid manifold and a low-pressure fluid manifold, at least one valve linking each working chamber of said working chambers to each manifold, the method comprising:

determining a mode of each working chamber of said working chambers on successive cycles of changing working chamber volume so as to vary the time averaged effective flow rate of fluid through the machine according to a demand level; and operating the valves of each of said working chambers to select the determined mode in accordance with an operation sequence which, in the successive cycles of changing working chamber volume, intersperses modes including at least (i) partial stroke modes in which only part of the usable volume of the chamber is used and (ii) full stroke modes in which all of the usable volume of the working chamber is used.

15. The method of claim 14, wherein the valves of each of said working chambers are operated to select the determined mode in accordance with the operation sequence which, in the successive cycles of changing working chamber volume, intersperses modes including at least (i) the partial stroke modes in which only part of the usable volume of the chamber is used, (ii) the full stroke modes in which all of the usable volume of the working chamber is used, and (iii) idling modes.

16. The method of claim 14, wherein the demand level is varied in use.

17. The method of claim 14, wherein the partial stroke modes comprise use of only a small fraction of the usable volume of the working chambers, and wherein the small fraction is one in which valve actuations are delayed to almost the end of the stroke such that a rate of change of working chamber volume will be at an acceptably low level to permit valve actuation.

18. The method of claim 14, wherein the partial stroke modes comprise use of only a small fraction of the usable volume of the working chambers, and wherein the small fraction is one that provides sufficient stability of valve operation at the low flow end.

19. The method of claim 14, wherein, in the partial stroke modes, valve actuations are delayed to almost an end of a stroke such that a rate of change of working chamber volume will be at an acceptably low level to permit valve actuation.

20. The method of claim 14, wherein the partial stroke mode is a part stroke motoring mode in which the transition from intake from the high-pressure manifold to intake from the low pressure manifold happens a small fraction after top dead center, wherein the small fraction is one in which valve actuations are such that a rate of change of working chamber volume will be at an acceptably low level to permit valve actuation.

21. The method of claim 14, wherein the sequence of modes of operation is tailored for one or more of the smoothest flow result, the most seamless change in audible noise, minimal pressure ripple, and optimum actuator motion.

* * * * *